United States Patent [19]

Schroder

[11] Patent Number: 4,915,197

[45] Date of Patent: Apr. 10, 1990

[54] ELEVATOR CALL REGISTERING AND INDICATING DEVICE

[75] Inventor: Joris Schroder, Lucerne, Switzerland

[73] Assignee: Inventio AG, Switzerland

[21] Appl. No.: 280,158

[22] Filed: Dec. 5, 1988

[30] Foreign Application Priority Data

Aug. 10, 1988 [CH] Switzerland ..... 04949/87

[51] Int. Cl.[4] ..... B66B 1/14

[52] U.S. Cl. ..... 187/121

[58] Field of Search ..... 187/121, 124, 130, 132

[56] References Cited

U.S. PATENT DOCUMENTS

| | | | |
|---|---|---|---|
| 3,493,922 | 2/1970 | Laas | 187/121 |
| 4,600,087 | 7/1986 | Tsuji | 187/121 |
| 4,735,294 | 4/1988 | Schroder | 187/121 |
| 4,836,336 | 6/1989 | Schroder | 187/121 |

FOREIGN PATENT DOCUMENTS

| | | |
|---|---|---|
| 2176043 | 10/1973 | European Pat. Off. . |
| 0032213 | 7/1981 | European Pat. Off. . |
| 0050304 | 6/1984 | European Pat. Off. . |
| 0246395 | 11/1987 | European Pat. Off. . |

*Primary Examiner*—A. D. Pellinen

*Assistant Examiner*—W. E. Duncanson, Jr.

*Attorney, Agent, or Firm*—Marshall & Melhorn

[57] ABSTRACT

A call registering and indicating device includes a keyboard wherein calls for desired floors of destination can be entered without pressing a register key after a correct input or pressing a correction key after an incorrect call input. A call input is possible only if a proximity switch connected with the call input keyboard is activivated. On deactivation of the proximity switch, a delay circuit causes the call to be automatically registered. An erroneously entered call is automatically cancelled by means of a second control circuit, where simultaneouly a second indicating element lights up in the form of a double question mark. A third indicating element, signaling the selected elevator, located on the same indicating panel, as well as a fourth and fifth indicating element, signaling the position of the selected elevator in relation to the actuated keyboard, are connected with a group control circuit by way of further control circuits. In response to the call assignment, the third and the fourth or fifth indicating elements are activated, which then will light up together with a first indicating element signaling the selected floor of destination at the input of the call.

14 Claims, 2 Drawing Sheets

ELEVATOR CALL REGISTERING AND INDICATING DEVICE

BACKGROUND OF THE INVENTION

The invention relates in general to elevator call registering and indicating devices and, in particular, to such devices for the immediate assignment of destination calls.

One known type of elevator call registering and indicating device has a keyboard for the input of calls for desired floors of destination, call memories and an indicating element which signals the desired floor of destination. A first control circuit, connected with the keyboard and the indicating element, activates the indicating element at the input of a call.

U.S. Pat. No. 3,493,922 shows a call registering and indicating device arranged in an elevator car which has a ten key keyboard for the input of car calls and an indicating panel for the indication of the selected floor. In order for the entered call to be stored and transferred to the elevator control, an additional registering key has to be actuated within a predetermined time. If the registering key is not actuated, it will light up after expiration of the predetermined time. The entered call is automatically cancelled after a further predetermined time if no action is taken in response to this signal. A further key permits a call to be cancelled, if it was, for example, entered incorrectly or erroneously. As can be seen from the preceding, the call input or entering requires increased attention of the passenger. Also, incorrectly entered calls or carelessness result in an increased loss of time for each entered call, so that in the case of several simultaneously entering-passengers, unpleasant situations can arise due to delays.

A group control for elevators, shown in the European Patent Application No. 0,246,395, has call registering devices which include a ten key keyboard. However, the call registering devices are located at the floors and no call buttons are provided in the elevator cars. Calls for desired floors of destination are entered and a call characterizing the input floor is stored in the floor call memories and the calls characterizing the floors of destination are stored in the car call memories of the elevators. In order to simplify and accelerate the call entering process, the call registering device includes, in place of the registering push button used in the prior art devices, a time limiting circuit. The limiting circuit is activated on input of a first number and requires that the second number of a call has to be entered within a predetermined time, wherein the entered call is automatically registered after expiration of this time. If the second number is not entered in the time limitation however, it is possible to experience incorrect call entries.

The group control described above has a computer in the form of a microprocessor and a comparison device for each elevator. The computer, immediately after the registration of a call and from data specific to the elevator, calculates a sum corresponding to the average waiting time of the passengers, also called operating costs. During a comparison of the operating costs of all elevators following immediately thereafter, the elevator with the smallest operating costs is determined, to which elevator the respective call is then assigned. Since at the input of the call at a floor, a car call characterizing the desired floor of destination is also being stored, the latter can also be considered in the calculation of the operating costs, so that the car established in the comparison is not only the most advantageous for the servicing of the input floor, but also for the floor of destination.

In group controls in which the floor and car calls are entered in a customary manner by means of call buttons arranged on the floors and respectively in the car, a passenger has to select twice in order to arrive at his/her destination. The control device is therefore informed relatively late of the desired destination of travel, which destination therefore cannot be considered for the assignment of the respective floor call. The car determined in the course of the assignment process is therefore the most advantageous for the respective floor call, but generally not for the destination unknown at the time of calculation. To obtain better results, as shown for example in European Pat. No. 0,032,213, the calculation and assignment of a floor call is postponed to a time at which the transfer to the drive control has to take place for the purpose of initiation of the stop at the respective floor. Under this method of operation, the assigned car can be made known to the passengers waiting at a floor only shortly prior to arrival, for example, through illumination of a direction indicator arranged above the respective elevator door and by an acoustical signal. In larger installations with several elevators, this operation could give rise to difficulties for the passengers, as there remains relatively little time to recognize the indication and to move in time to the indicated elevator.

SUMMARY OF THE INVENTION

The present invention is based on the problem of providing a call registering and indicating device in which, on the one hand, the call input is not limited to specified times so that incorrect entries can be recognized and corrected easier, and in which, on the other hand, the car selected immediately after the input of a call is indicated to the passenger instantly and conspicuously. This problem is solved by the present invention in which a call input is only possible if a proximity switch connected with the call input keyboard is activated. On the deactivation of the proximity switch, a delay circuit causes an automatic registration of the entered call as displayed by a first indicating element located in an indicating panel.

A second indicating element, located in the indicating panel and signaling an incorrect input, is activated by means of a second control circuit which causes simultaneously the automatic cancellation of the incorrect input. A third indicating element, located in the same indicating panel, signals the selected elevator, and fourth and fifth elements signal the position of the selected elevator in relation to the actuated keyboard and are connected with a group control device by way of further control circuits. Upon assignment of the call, the third, and fourth or fifth indicating elements are activated, which then light up together with the first indicating element which signals the selected floor and was already activated at the input of the call.

The advantages gained with the present invention are that after the call input, neither a registering key, nor a correction key has to be depressed, so that time can be saved and the inputting process simplified for the passenger. By the omission of the specified input time, an improved operation is realized and the registering of incorrectly entered calls is avoided to the benefit of the passenger. The advantage gained with regard to the indicators is that on input of a non-existing floor, a symbol, not the floor number, is indicated which notifies the passenger and communicates the incorrect input. The arrangement of the indicating elements in the indicating panel, signaling the selected elevator and its position, causes the passenger to notice the respective symbols lighting up immediately after the input of a call, so that he/she can move in time to the selected elevator.

BRIEF DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
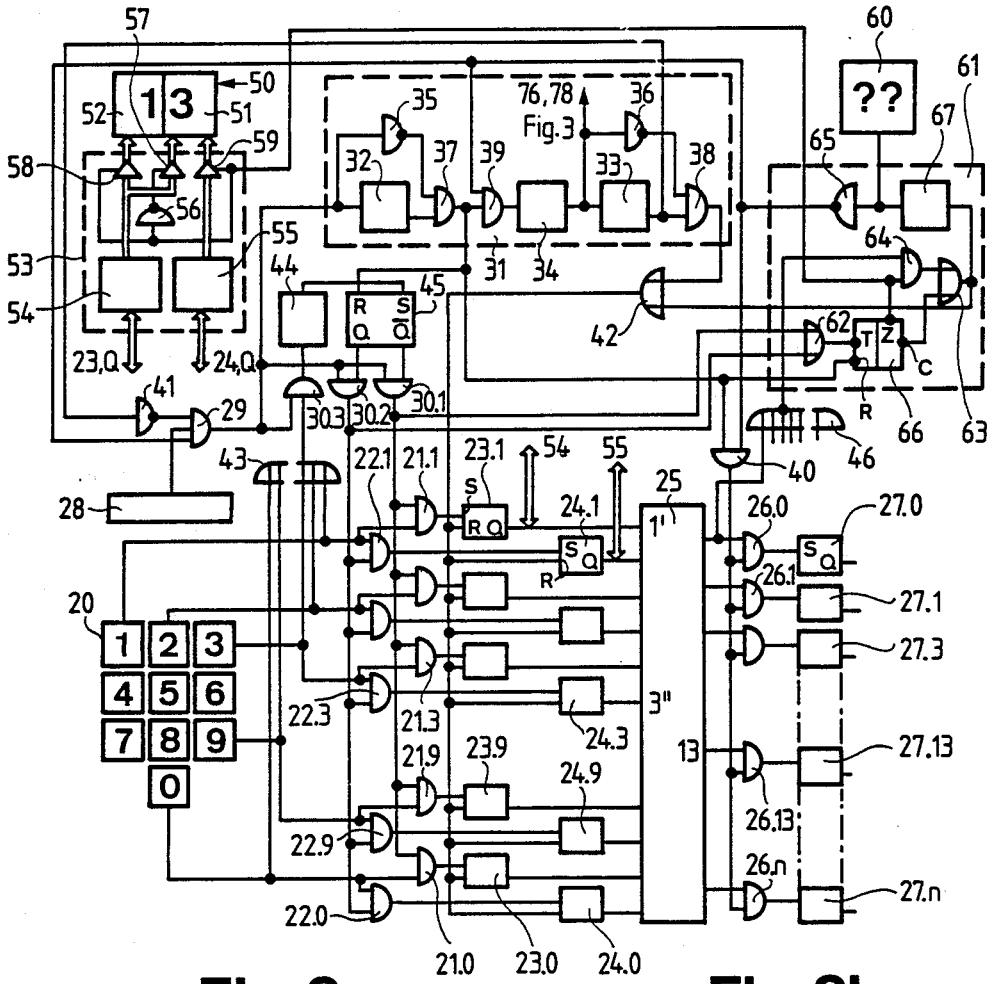
FIG. 1 is a circuit schematic of a call registering and indicating device according to the present invention.

As shown in FIG. 1, the call registering and indicating device according to the present invention for one and two digit calls includes a keyboard 20 which has ten keys "0" through "9" for the input of calls to the desired floors of destination. Thus, some elements in the drawings will be identified with reference numerals indexed with decimals "0.0" through "0.9" corresponding to the associated keys while other such reference numerals are associated with the floor number or simply designate one of a plurality of like elements.

The keys "1 . . . 9, 0" are connected to first inputs of a first plurality of AND-gates 21.1 . . . 21.9, 21.0 respectively, the outputs of which are connected with set-inputs "S" of a first plurality of key memories 23.1 . . . 23.9, 23.0 respectively for the storage of an initially entered number. The keys "1 . . . 9, 0" are furthermore connected with first inputs of a second plurality of AND-gates 22.1 . . . 22.9, 22.0 respectively, the outputs of which are connected with set-inputs "S" of a second plurality of key memories 24.1 . . . 24.9, 24.0 respectively for the storage of a second entered number. RS-flip-flops can be used as the key memories for example.

The outputs "Q" of all key memories 23 and 24 are connected with the inputs of a combinatorial logic circuit 25, the outputs of which are connected to first inputs of a third plurality of AND-gates 26.0, 26.1 . . . 26.*n*. The outputs of the third plurality of AND-gates are connected with set-inputs "S" of a plurality of call memories 27.0, 27.1 . . . 27.*n*, respectively assigned to the floors, in the form of RS-flip-flops for example. The combinatorial logic circuit 25 operates in such a manner, that on input of a single digit call, one of the call memories 27.0, 27.1 . . . 27.9 assigned to the floors of single digit numbers is set and on input of a two digit call, one of the call memories 27.10 . . . 27.*n* assigned to the floors of two digit numbers is set. If, for example, calls for the floors one and thirteen are entered, the combinatorial logic has to satisfy the equations $$1 = 1' \wedge \overline{2'} \wedge \overline{3'} \ldots \wedge \overline{9'} \wedge \overline{0'} \wedge \overline{1''} \ldots \wedge \overline{9''} \wedge \overline{0''}$$

$$13 = 1' \wedge \overline{2'} \wedge \overline{3'} \ldots \wedge \overline{9'} \wedge \overline{0'} \wedge \overline{1''} \wedge \overline{2''} \wedge 3'' \ldots \wedge \overline{9''} \wedge \overline{0''}$$

where the input variables 1', 2', 3'. . . stand for the first entered number and 1", 2", 3", stand for the second entered number and the output variables "1, 13" signify the selected floors of destination. The scanning of the call memories 27.0, 27.1 . . . 27.*n* and the transfer of the calls into a group control device (FIG. 3) takes place in the same manner as in the call registering device shown in the European Patent Application No. 0,246,395.

A proximity switch 28 operates according to the capacitive detection principle and is activated on the approach of the hand of a passenger to the keyboard 20. The proximity switch 28 is connected at its output to one input of a fourth AND-gate 29 having three inputs, the output of which is connected with one input each of a fifth, sixth and seventh AND-gate 30.1, 30.2, 30.3, each having two inputs, and with a delay circuit 31 explained in more detail below. The output of the fifth AND-gate 30.1 is connected to the second inputs of the first plurality of AND-gates 21.1 . . . 21.9, 21.0 and the output of the sixth AND-gate 30.2 is connected to the second inputs of the second plurality of AND-gates 22.1 . . . 22.9, 22.0.

The delay circuit 31 includes a first and second delay element 32 and 33, a monoflop 34, a first and second NOT-gate 35 and 36, and a first, second and third AND-gate 37, 38 and 39 each having two inputs. The input of the first delay element 32 is connected with the output of the fourth AND-gate 29 and through the first NOT-gate 35 with one input of the first AND-gate 37, the other input of which is connected to the output of the first delay element 32. The output of the first AND-gate 37 is connected with one input of the third AND-gate 39. The output of the third AND-gate 39 is connected to the input of the monoflop 34, the output of which is connected with the input of the second delay element 33 and through the second NOT-gate 36 with one input of the second AND-gate 38. The output of the first AND-gate 37 is connected furthermore with one input of a further AND-gate 40 having two inputs, the output of which is connected with the second inputs of the third plurality of AND-gates 26.0, 26.1 . . . 26.*n*. The output of the second delay element 33 is connected, through a further NOT-gate 41, to the second input of the fourth AND-gate 29 and is connected with the other input of the second AND-gate 38. The output of the second AND-gate 38 is connected, through an OR-gate 42 having two inputs, with the reset-inputs "R" of the key memories 23 and 24.

The keys of the keyboard 20 are connected through an OR-gate 43 to the other input of the seventh AND-gate 30.3, the output of which is connected through a further delay element 44 with the set-input "S" of an RS-flip-flop 45. The outputs "$\overline{Q}$" and "Q" of the RS-flip-flop 45 are connected with the other inputs of the fifth and sixth AND-gates 30.1 and 30.2 respectively. The reset-input "R" of the RS-flip-flop 45 is connected to the output of the first AND-gate 37 of the delay circuit 31.

A first indicating element 50 includes a first and second seven-segment indicator 51 and 52 formed by light emitting diodes (LED'S), by means of which the selected floor destination can be signaled upon a call input in the form of a one or two digit number. A first control circuit 53 connected with the first indicating element 50 includes a first and second coding circuit 54 and 55, a NOT-gate 56 and first, second and third tristate buffers 57, 58 and 59. The first coding circuit 54 is connected at its input with the outputs "Q" of the key memories 23.1 . . . 23.9, 23.0 for an initially entered number. The circuit 54 is connected at its output, through the first tristate buffers 57, with the first seven segment indicator 51, and, through the second tristate buffers 58, with the second seven segment indicator 52. The second coding circuit 55 is connected at its input with the outputs "Q" of the key memories 24.1 . . . 24.9, 24.0 for a secondly entered number. The circuit 55 is connected at its output, by way of the third tristate buffers 59, with the first seven segment indicator 51. The coding devices 54 and 55 change in a known manner the one to ten code into a code suitable for the seven segment indicators 51 and 52. The activating connections of the second and third tristate buffers 58 and 59 are connected with a second control circuit 61 explained in more detail below, and through the NOT-gate 56 with the activating connections of the first tristate buffers 57.

A second indicating element 60, in the form of a double question mark signaling an incorrect call input, is formed by light emitting diodes (LED's) and can be activated by the second control circuit 61. The second control circuit 61 includes a first and second OR-gate 62 and 63 each having two inputs, and AND-gate 64 having two inputs, a NOT-gate 65, a two digit counter 66 and a monoflop 67. A clock input "T" of the two digit counter 66 is connected to the output of the first OR-gate 62, the inputs of which are connected with the outputs of the fifth and sixth AND-gates 30.1 and 30.2. A transfer output "C" of the counter 66 is connected to an input of the second OR-gate 63, the output of which is connected with the input of the monoflop 67 and with the other input of the OR-gate 42. The output of the monoflop 67 is connected with the second indicating element 60, and through the NOT-gate 65 with the third input of the fourth AND-gate 29, and with the other inputs of the third AND-gate 39 of the delay circuit 31 and of the further AND-gate 40.

The one input of the AND-gate 64 is connected to a data output "Z" of the second stage of the counter 66, and the other input to the output of a NOR-gate 46. The inputs of the NOR-gate 46 are connected with the outputs of the combinatorial logic circuit 25. A reset-input "R" of the two digit counter 66 is connected with the output of the first AND-gate 37 of the delay circuit 31, and the data output "Z" of the second stage is connected with the activating connections of the second and third tristate buffers 58 and 59 of the first control circuit 53.

Figure 2A:
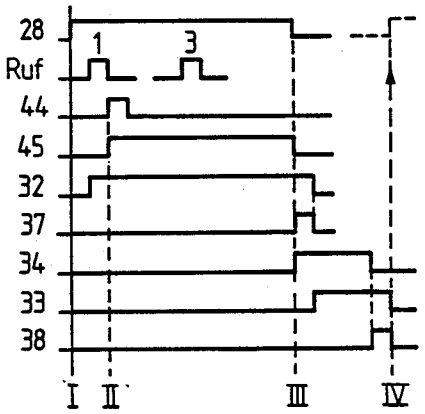
FIGS. 2*a* and 2*b* are two diagrams of the magnitude versus time of the signals generated by the call registering and indicating device of FIG. 1.

The call registering and indicating device described above with the aid of FIG. 1 operates in the following manner: On approach of the hand of a passenger to the keyboard 20, the proximity switch 28 generates a signal logic "1" for the duration of the approach (instant I, FIG. 2*a*). It is assumed that the remaining inputs of the fourth AND-gate 29 are likewise at "1" such that the associated inputs of the fifth, sixth and seventh AND-gates 30.1, 30.2 and 30.3 are set at "1". The not-set RS-flip-flop 45 has its output "$\overline{Q}$" at the state "1", so that the AND-gates 21.1 . . . 21.9, 21.0 are released for the call input. On input of a call, for example, for the floor thirteen, the number one key is actuated which generates a short pulse (Ruf, FIG. 2*a*) and sets the associated key memory 23.1 by way of the AND-gate 21.1. After a delay, caused by the further delay element 44, the RS-flip-flop 45 is set so that its other output "Q" will be at the state "1" (instant II, FIG. 2*a*).

The AND-gates 22.1 . . . 22.9, 22.0 are released and the AND-gates 21.1 . . . 21.9 . . . 21.0 are blocked so that on actuation of the number three key, the associated key memory 24.3 is set by the AND-gate 22.3. The combinatorial logic circuit 25 thereby receives the input variables 1' and 3'' and the output variable "13" is assigned to the call memory 27.13 for the floor thirteen. Since on input of the number one only the first tristate buffers 57 are assumed to be activated, the seven segment indicator 51 located on the right side of the first indicating element 50 will light up correspondingly. On input of the number three and arrival of a signal "1" from the data output "Z" of the second stage of the counter 66, the first tristate buffers 57 are deactivated and the second and third tristate buffers 58 and 59 are activated. Now the second seven segment indicator 52, located on the left side, will indicate the number one and the seven segment indicator 51, located on the right side, will indicate the number three. If the passenger removes his/her hand from the keyboard 20, a first pulse is generated by the dropping side of the output signal of the proximity switch 28 and of the first delay element 32 at the output of the first AND-gate 37 of the delay circuit 31, by means of which the AND-gates 26.0, 26.1 . . . 26.*n* are released and the call memory 27.13 assigned to the floor thirteen is set (instant III, FIG. 2*a*). At the same time, the counter 66 and the RS-flip-flop 45 are reset and the monoflop 34 is switched. During the switching-on time of the monoflop 34, lasting for instance two seconds, no call input is possible because the fourth AND-gate 29 is blocked by way of the further NOT-gate 41. Due to the dropping sides of the output signals of the monoflop 34 and the second delay element 33, a second pulse is generated at the output of the second AND-gate 38 of the delay circuit 31, by means of which all key memories 23 and 24 are reset, with the indication of the entered call being cleared or erased and the blocking of the call input again being released (instant IV, FIG. 2*a*).

Figure 2B:
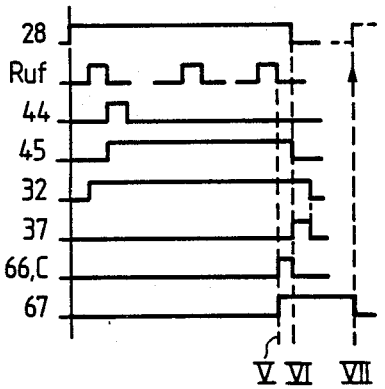

Let it now be assumed that a passenger, after input of a two digit number, actuates a further number without removing his/her hand from the keyboard 20. In this case, there appears on the transfer output "C" of the counter 66 a signal "1", so that the key memories 23 and 24 are reset and the indication of the call is erased. At the same time, the monoflop 67 of the second control circuit 61 is switched, whereby the second indicating element 60 is activated and the erroneous or incorrect call input is signaled (instant V, FIG. 2*b*). A renewed call input is blocked by the elements 65, 29, 30.1, 30.2 and 30.2. After a delay caused by the transit time of the transfer signal, a first pulse is generated at the output of the AND-gate 37, as described above, by means of which the RS-flip-flop 45 and the counter 66 are reset, whereby the transfer signal disappears (instant VI, FIG. 2*b*). The blocked AND-gates 39 and 40 thereby prevent the setting of the monoflop 34 of the delay circuit 31 and the call memories 27. After a switching-on time of the monoflop 67, lasting for example half a second, the second indicating element 60 is erased with the call input again being released (instant VII, FIG. 2*b*).

On input of a two-digit number for a not-existing floor, the output of the NOR-gate 46 remains in the state "1" because the combinatorial logic circuit 25 does not generate any outputs for non-existing floors. At the same time, there appears at the data output "Z" of the second stage of the counter 66, a signal "1" so that the monoflop 67 is switched and the same processes take place as previously described (instants V, VI, VII, FIG. 2*b*). The erroneous input of a one or two digit number of an existing floor can be voided by the passenger through actuation of one or two arbitrary keys respectively, in which case the processes described in the preceding again take place.

Figure 3:
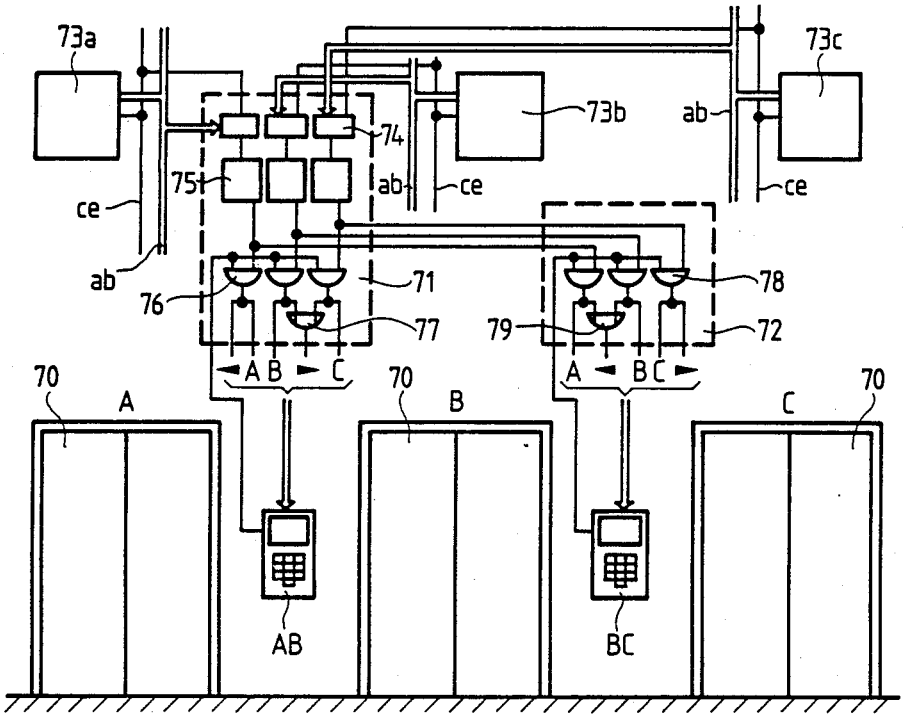
FIG. 3 is a circuit schematic for an elevator group consisting of three elevators and utilizing the call registering and indicating device of FIG. 1.

In FIG. 3, the shaft doors 70 of three elevators "A", "B" and "C" of a group of elevators are located adjacent one another on a floor. Provided between the shaft doors 70 are call registering and indicating devices "AB" and "BC" which are connected through control circuits 71 and 72, described in detail below, with microcomputer systems 73*a*, 73*b* and 73cassigned to the elevators "A", "B" and "C" respectively. The systems form a group control as shown in the European Patent Application No. 0,246,395. The control circuit 71 includes three address decoders 74, three monoflops 75, three AND-gates 76 each having two inputs and an OR-gate 77 having two inputs. The control circuit 72 includes only three AND-gates 78 and one OR-gate 79, which likewise each have two inputs. The address decoders 74 are connected at their inputs each with an address bus "ab" and a module release conductor "ce" of the associated microcomputer systems 73*a*, 73*b* and 73*c*.

The address decoders 74 are connected at their outputs with the inputs of the monoflops 75, the outputs of which are connected to an input each of the AND-gates 76. The other inputs of the AND-gates 76 are connected with the output of the monoflop 34 (FIG. 1) of the call registering and indicating device "AB". The outputs of the monoflops 75 are furthermore connected to one input each of the AND-gates 78, the other inputs of which are connected with the output of the monoflop 34 (FIG. 1) of the other call registering and indicating device "BC". The outputs of the AND-gates 76 and 78 are connected with indicating elements which are described in more detail with the aid of the FIGS. 4–6. The control circuits 71 and 72 are preferably built into the call registering and indicating devices "AB" and "BC" respectively. The call registering and indicating devices "AB" and "BC" are connected with each other (not shown), in such a manner that on actuation of one, the other one is blocked.

Figure 4:
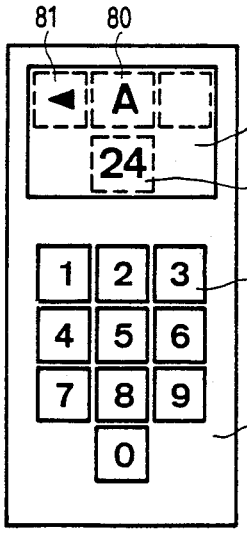
FIGS. 4–6 are each one view of the call registering and indicating device of FIG. 1 showing three different examples of elevator call indication.
Figure 5:
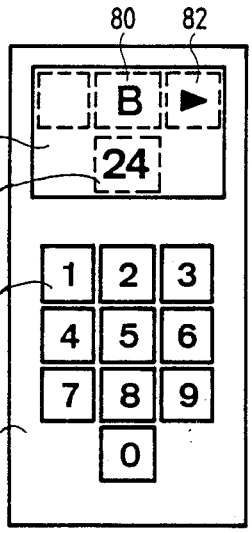
Figure 6:
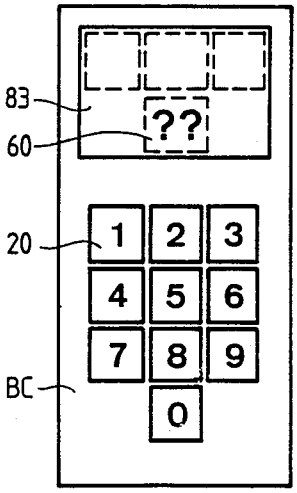

Designated with 80, 81 and 82 in the FIGS. 4–6 are a third, fourth and fifth indicating element respectively, which are located in an indication panel 83 of the call registering and indicating device. The indicating elements 80, 81 and 82 are formed of light emitting diodes (LED's) arranged in a pattern, by means of which, on activation, the letters "A", "B" and "C" can be formed in the third indicating element 80. In the fourth indicating element 81, a leftward pointing arrow, and in the fifth indicating element 82, a rightward pointing arrow can be formed. The light emitting diodes (LED's) of the second indicating element 60 (FIG. 6) are preferably located between the light emitting diodes (LED's) of the first indicating element 50 (FIGS. 4 and 5). Corresponding to the three letters "A", "B" and "C", the third indicating element 80 has three activating connections which are connected with the outputs of the respective AND-gates 76 and 78.

In the one call registering and indicating device "AB", the fourth indicating element 81 is connected to the output of the AND-gate 76 assigned to the elevator "A", and the fifth indicating element 82 is connected through the OR-gate 77 to the outputs of the AND-gates 76 assigned to the elevators "B" and "C". In the other call registering and indicating device "BC", the fourth indicating element 81 is connected through the OR-gate 79 with the outputs of the AND-gates 78 assigned to the elevators "A" and "B", and the fifth indicating element 82 is connected with the output of the AND-gate 78 assigned to the elevator "C".

The call registering and indicating device described above with the aid of FIGS. 3–6 operates in the following manner: Let it be assumed that a passenger on floor fifteen enters, for example, a call for floor twenty-four by the call registering and indicating device "AB". In so doing, the first indicating element 50 lights up correspondingly, as described with the aid of FIGS. 1, 2*a* and 2*b*. After the passenger has removed his/her hand from the keyboard 20, the call is sent to the group control, as described in the European Patent Application No. 0,246,395 , and immediately that elevator which can service the call in the best manner is determined. Let it now be assumed that the call had been assigned to the elevator "A", and that the assignment is final. As known from the earlier cited publication and the European Patent No. 0,050,304, a program is executed in the microcomputer system 73*a*, by means of which an assignment statement concerning the call is written in an assignment memory.

At the end of the program, the microcomputer system 73*a* generates the address of the floor fifteen to the address bus "ab" and releases the address decoder 74 of the elevator "A" by way of the module release conductor "ce". The output of the respective address decoder 74 will therefore become "1", so that the assigned monoflop 75 is switched. Since upon the switch-on of the monoflop 34 (FIG. 1) of the actuated call registering and indicating device "AB" the AND-gates 76 are released, the output of the AND-gate 76 assigned to the elevator "A" generates the state "1" so that the letter "A" of the third indicating element 80 and the fourth indicating element 81 are activated. In this manner, the passenger is informed immediately after entering a call about the assigned elevator and its position with-respect to the actuated call registering and indicating device (FIG. 4). After the switching-on time of the monoflop 75 of, for example, two seconds, the third an fourth indicating elements 80 and 81 extinguish simultaneously with the first indicating element 50 showing the entered floor number.

If the call for the floor twenty-four is assigned, for example, to the elevator "B", the same processes described above will take place, where however the output of the AND-gate 76 assigned to the elevator "B" exhibits the state "1", so that the letter "B" of the third indicating element 80 and the fifth indicating element 82 are activated (FIG. 5). If a passenger has, for instance, entered a number for a nonexisting floor by means of the other call registering and indicating device "BC", the second indicating element 60 is activated, as described with the aid of the FIGS. 1, 2*a* and 2*b*, and the double question mark is signaled (FIG. 6).

In a preferred embodiment, not further described in detail, the signal of the first indicating element 50 is intermittent until the switching-on of the respective monoflop 75, and the signal of the fourth and fifth indicating elements 81 and 82, are intermittent during its entire switching-on duration. Instead of the proximity switch 28 operating according to the capacitive detection principle as mentioned in the description of FIG. 1, it is also possible to use infrared reflex sensors or temperature sensors.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A call registering and indicating device for elevators with immediate assignment of calls of destination, including a keyboard for the input of calls for desired floors of destination, call memories and an indication panel in which at least a first indicating element signaling the selected floor of destination is located, and where a first control circuit connected with the keyboard and the first indicating element is provided, by means of which the first indicating element can be activated on input of the call, comprising:

a switching device connected with a call input keyboard for releasing the keyboard for the input of calls and thereafter blocking the keyboard, whereby an entered call is only processed further after the blocking;

a second indicating element for indicating an incorrect call input located in an indication panel and connected through a second control circuit to the keyboard, to call memories for storing the calls, and to a delay circuit, whereby said second indicating element is activated by said second control circuit and an incorrectly entered call is automatically cancelled;

a third indicating element signaling the selected elevator and a fourth and fifth indicating element signaling the position of the selected elevator in relation to the actuated keyboard are located in the indication panel; and further control circuits connect said third, fourth and fifth indicating elements with a group control device, whereby on the assignment of calls, said third and one of said fourth and fifth indicating elements are activated and light up together with a first indicating element located in the indication panel and which has already been activated on the input of the call.

2. The call registering and indicating device according to claim 1 wherein said switching device includes a proximity switch which is connected with said delay circuit for releasing the keyboard on the approach of a hand and blocking it again on removal of the hand, whereupon an entered call is automatically registered.

3. The call registering and indicating device according to claim 2 wherein said delay circuit includes a first and second delay element, a monoflop, a first and second NOT-gate and a first, second and third AND-gate, an input of said first delay element is connected through said first NOT-gate with an input of said first AND-gate, another input of said first AND-gate is connected to an output of said first delay element, an output of said first AND-gate is connected to one input of said-third AND-gate, an output of said third AND-gate is connected to an input of said monoflop, an output of said monoflop is connected with to an input if said second delay element and through said second NOT-gate of an input of said second AND-gate, and another input of said second AND-gate is connected to an output of said second delay element.

4. The call registering and indicating device according to claim 3 wherein the keyboard has a plurality of keys connected by way of first inputs of a first plurality of AND-gates with set-inputs of a first plurality of key memories for the storage of an initially entered number, and connected by way of first inputs of a second plurality of AND-gates with set-inputs of a second plurality of key memories for the storage of a second entered number, and wherein outputs of all said key memories are connected with inputs of a combinatorial logic circuit having outputs connected with set-inputs of the call memories through a third plurality of AND-gates, said proximity switch is connected through a fourth AND-gate with said input of said first delay element of said delay circuit and with an input of each of a fifth, sixth and seventh AND-gate, the keys of the keyboard are connected through an OR-gate and said seventh AND-gate and a further delay element to a set-input of an RS-flip-flop, outputs of said RS-flip-flop are connected to inputs of said first and second pluralities of AND-gates through said fifth and sixth AND-gates respectively, and a reset-input of said RS-flip-flop is connected with said output of said first AND-gate of said delay circuit and through a further AND-gate to said third plurality of AND-gates, and a reset-input of all said key memories are connected through a further OR-gate to an output of said second AND-gate of said delay circuit, whereby on activation of said proximity switch, said first plurality of AND-gates are released and on input of a first number the respective one of said first key memories is set immediately and said RS-flip-flop is set with delay, so that said first plurality of AND-gates are blocked and said second plurality of AND-gates are released, and whereby on the deactivation of said proximity switch a first pulse is generated at said output of said first AND-gate of said delay circuit, and a second pulse is generated at said output of said second AND-gate of said delay circuit, and the respective one of said call memories is set by said first pulse, said RS-flip-flop is reset and said monoflop is switched, and the respective ones of said key memories are reset by said second pulse.

5. The call registering and indicating device according to claim 4 wherein said second control circuit includes a first and second OR-gate, an AND-gate, a NOT-gate, a two digit counter and a monoflop, a clock input of said counter is connected to an output of said first OR-gate, inputs of said first OR-gate are connected with said outputs of said fifth and sixth AND-gates, a transfer output of said counter is connected with an input of said second OR-gate, a data output of a second stage of said counter is connected through said AND-gate with another input of said second OR-gate, another input of said AND-gate is connected through a NOR-gate to said outputs of said combinatorial logic circuit, and an output of said second OR-gate is connected through said further OR-gate with said reset-inputs of said key memories and with an input of said monoflop, an output of said monoflop is connected with said second indicating element and through said NOT-gate (65) to a third input of said fourth AND-gate and to another input of each of said third AND-gate of said delay circuit and said further AND-gate, whereby on input of a two or more digit number for a non-existing floor, said second indicating element is activated, said key memories are reset and the input of a further call is blocked for the switching-on time of said monoflop.

6. The call registering and indicating device according to claim 3 wherein one of said further control circuits includes a plurality of address decoders corresponding to the number of elevators of an elevator group, a plurality of monoflops, a plurality of AND-gates and an OR-gate, inputs of said address decoders are connected to an address bus and a module release conductor of a microcomputer system of the group control device assigned to the respective elevator, and outputs of said address decoders connected to inputs of said plurality of monoflops, outputs of said plurality of monoflops connected an input of associated ones of said plurality of AND-gates, other inputs of said plurality of AND-gates being connected to said output of said monoflop of said delay circuit, and outputs of said plurality of AND-gates are connected with said third indicating element, an output of the one of said plurality of AND-gates assigned to one elevator is connected to said fourth indicating element, and outputs of the ones of said plurality of AND-gates assigned to the other elevators are connected through said OR-gate with said fifth indicating element, whereby on input of a call, said monoflop of said delay circuit is switched and said plurality of AND-gates are released, and whereby at the assignment of the call to a specific elevator by means of a module release signal and the address corresponding to the call input floor, the assigned one of said address decoders is activated and the assigned one of said plurality of monoflops is switched, so that said third and respective fourth or fifth indicating elements are activated.

7. The call registering and indicating device according to claim 1 wherein said second indicating element is in the form of a double question mark and is formed of light emitting diodes.

8. The call registering and indicating device according to claim 1 wherein said fourth indicating element is formed as a leftward pointing arrow, and said fifth indicating element is formed as a rightward pointing arrow, and both are formed of light emitting diodes.

9. The call registering and indicating device according to claim 1 wherein said third indicating element is located at the center of the indication panel above the first indicating element, and said fourth indicating element is located to the left of and said fifth indicating element is located to the right of and adjacent said third indicating element.

10. The call registering and indicating device according to claim 2 wherein said proximity switch is a capacitive proximity switch.

11. The call registering and indicating device according to claim 2 wherein said proximity switch is an infrared reflex sensor.

12. The call registering and indicating device according to claim 2 wherein said proximity switch is a temperature sensor.

13. In an elevator system, a call registering and indicating device for the immediate assignment of calls of destination to elevator cars comprising:

a keyboard for the input of calls for desired floors of destination located adjacent a shaft door of an elevator;

an indication panel in which first, second, third, fourth, and fifth indicating elements are located adjacent the shaft door of the elevator;

a plurality of call memories;

a first control circuit connected to said keyboard and to said first indicating element and responsive to the input of a call for activating said first indicating element for signaling the associated floor of destination;

a switching device connected to said keyboard for releasing said keyboard for the input of calls and thereafter blocking said keyboard, whereby an entered call is only processed further after the blocking;

a second control circuit connected to said keyboard, to said call memories and to said second indicating element for indicating an incorrect call input and automatically cancelling an incorrectly entered call;

further control circuits connected to said third, fourth and fifth indicating elements whereby on the assignment of calls, said third and one of said fourth and fifth indicating elements are activated and light up together with said first indicating element which has already been activated on the input of the call; and a group control device connected to said call memories and said further control circuits.

14. A call registering and indicating device for elevators in an elevator system, including a keyboard for the input of calls for desired floors of destination, call memories and an indicatin panel in which at least a first indicating element signaling the selected floor of destiation is located, and a first control circuit connected with the keyboard and the first indicating element for activating the first indicating element on input of the call, comprising:

a proximity switch connected to a keyboard and a delay circuit for releasing the keyboard on the approach of a hand and blocking it again on removal of the hand, whereupon an entered call is automatically registered;

a second indicating element for indicating an incorrect call input located in an indication panel and connected through a second control circuit to the keyboard, to call memories for storing the calls, and to said delay circuit, whereby said second indicating element is activated by said second control circuit and an incorrectly call is automatically cancelled;

a third indicating element signaling the selected elevator and a fourth and fifth indicating element signaling the position of the selected elevator in relation to the actucated keyboard located in the indication panel; and further control circuits connected to said third, fourth and fifth indicating elements with a group control device, whereby on the assignment of calls, said third and one of said fourth and fifth indicating elements are activated and light up together with a first indicating element located in the indication panel which has already been activated on the input of the call.

* * * * *